US005865245A

United States Patent [19]

Trout et al.

[11] Patent Number: 5,865,245

[45] Date of Patent: Feb. 2, 1999

[54] STUFFING BOX GLAND

[75] Inventors: Lindell R. Trout, The Woodlands; Leslie Dean Smith, Fritch; Thomas Evans, Midland, all of Tex.

[73] Assignee: FCE Flow Control Equipment, Inc., Tomball, Tex.

[21] Appl. No.: 888,210

[22] Filed: Jul. 3, 1997

[51] Int. Cl.[6] ..... E21B 33/03

[52] U.S. Cl. ..... 166/84.2; 166/86.2; 166/177.3

[58] Field of Search ..... 166/81.1, 84.1, 166/84.2, 86.1, 86.2, 88.1, 177.3

[56] References Cited

U.S. PATENT DOCUMENTS

| | | | |
|---|---|---|---|
| 4,530,397 | 7/1985 | Calhoun | 166/84.2 |
| 4,647,050 | 3/1987 | Johnson | 166/84.2 X |
| 4,872,508 | 10/1989 | Gordon | 166/84.2 |
| 5,148,699 | 9/1992 | Morse | 166/84.1 X |

OTHER PUBLICATIONS

Huber–Hercules General Product Catalog HHG–94; Cover Page and Back Page of Catalog; pp. 18–20 dated May 1994.

*Primary Examiner*—Roger Schoeppel

*Attorney, Agent, or Firm*—Browning Bushman

[57] ABSTRACT

A stuffing box gland 20 that cooperates with packing 38 positioned within a stuffing box 18 to seal between a stuffing box housing 42 and a moveable polished rod 27 of an oilfield pump assembly 10. A lower end of a gland housing 46 forms a flange 50 extending radially outward from the gland housing 46 that is adapted for transmitting a variable compressive force to the packing 38, within the stuffing box 18. A plurality of attachment members 52 are utilized for interconnecting the gland housing flange 50 and the stuffing box housing flange 51 and may be adjusted to vary the compressive force exerted by the lower end 48 of the gland housing 46 on the packing 38. A sleeve 56 surrounds the polished rod 27 and includes a lower end 58 that seals with an annular seat 54. A pair of semi-cylindrical absorbent pads 100 and 110 are positioned radially inward of the fluid impermeable sleeve 56 and cooperate with a pair of absorbent wicks 116 and 118 for transmitting a lubricant from a fluid reservoir 64 to the absorbent pads 100 and 11, thereby lubricating the polished rod 27.

20 Claims, 2 Drawing Sheets

STUFFING BOX GLAND

FIELD OF THE INVENTION

The present invention relates to an oilfield stuffing box gland for cooperation with packing within a stuffing box to seal between a stuffing box housing and a moveable polished rod of an oilfield pumping assembly. More particularly, this invention relates to a stuffing box gland that cooperates with a stuffing box positioned below the stuffing box gland to seal the packing within the stuffing box and maximize retention of a lubricant within a fluid reservoir of the stuffing box gland for lubricating the polished rod as it moves through the stuffing box and stuffing box gland.

BACKGROUND OF THE INVENTION

Crude oil is typically pumped from underground reservoirs using a mechanical pumping unit which drives or powers a reciprocating string of sucker rods to actuate a subsurface pump. A well head assembly at the surface may include various components such as a tubing head, a pressure regulator, a blowout preventer, a stuffing box assembly, a polished rod lubricator, and a rod rotator. The stuffing box assembly seals with the reciprocating polished rod passing therethrough to prevent the well bore fluids from being vented to the atmosphere. The stuffing box assembly may be lubricated to ease the movement of the polished rod through the stuffing box and help prevent wear on the seals used to provide the sliding packoff with the polished rod. Other wells are pumped using a rotating rather than a reciprocating rod string, and a stuffing box assembly is also provided for sealing with this rotating rod string.

The makeup and design of a stuffing box assembly usually depends upon its use in either normal or difficult pumping situations. Under normal pumping conditions, a stuffing box may be connected to a blowout preventer at its lower end and an upper lubricating gland may be attached at its upper end to wipe the lubricating fluid from the polished rod as the rod passes through the stuffing box assembly, thereby retaining the lubricating fluid within the upper lubricating gland. Under difficult or abnormal pumping conditions, the upper lubricating gland may be replaced above the stuffing box with an oil reservoir gland or stuffing box gland which includes a fluid reservoir of lubricant that the polished rod moves freely through for lubricating and cooling the polished rod. Excess lubricant coated on the polished rod is retained within the oil reservoir gland by a wiper assembly similar to that of the upper lubricating gland to wipe the polished rod clean of any excess lubricant as it moves through the oil reservoir gland. However, much of the lubricant is typically lost or transmitted through the oil reservoir gland to the stuffing box due to a number of variables, such as gravity, movement of the polished rod and weak sealing engagement between the oil reservoir gland and stuffing box. Consequently, lubricant contained in the oil reservoir gland must often be replaced, causing unnecessary expense and delay. If the lubricant is not frequently replaced, the oil reservoir gland runs dry, thereby contributing to high wear between the moving polished rod and the stuffing box packing and, if not corrected, to high leakage of fluid past the stuffing box.

A polished rod lubricator may be installed as part of the stuffing box assembly under difficult or abnormal pumping conditions. The polished rod lubricator normally includes a pair of hinged fluid reservoirs that surround the polished rod and store a lubricant. The polished rod lubricator also includes an absorbent wick communicating between an absorbent pad and the lubricant in the fluid reservoir in order to control the rate of lubrication of the polished rod as it contacts the absorbent pad. Despite the use of various stuffing box assemblies, uniform and consistent lubrication of the polished rod remains problematic.

The foregoing disadvantages of the prior art are overcome by the present invention, which provides a relatively simple and highly reliable stuffing box gland capable of both cooperating with a stuffing box positioned below the stuffing box gland to compressively seal the packing within a stuffing box, and maximize retention of a lubricant within a fluid reservoir of the stuffing box gland for uniform and consistent lubrication of the polished rod as it moves relative to the stuffing box gland.

SUMMARY OF THE INVENTION

The stuffing box gland of the present invention cooperates with packing positioned within a stuffing box to seal between a stuffing box housing and a moveable polished rod of an oilfield pumping assembly. The stuffing box gland comprises a gland housing having a central passageway therethrough for receipt of the polished rod that is moveable relative to the stuffing box housing and stuffing box gland. A lower end of the gland housing forms a flange extending radially outward from the gland housing that is adapted for transmitting a variable compressive force to the packing within the stuffing box. The compressive force is varied contingent upon the application of a compressive force to the packing in the stuffing box gland and stuffing box housing. Accordingly, a plurality of attachment members are utilized for interconnecting the gland housing flange and the stuffing box housing flange that may be adjusted to vary the compressive force exerted by the lower end of the gland housing on the stuffing box packing.

An annular seat is fixedly positioned within the gland housing and circumferentially about the central passageway for receipt of a fluid impermeable sleeve that surrounds the polished rod, the sleeve includes a lower end that seals with the annular seat. An exterior surface of the fluid impermeable sleeve and an interior surface of the gland housing define a fluid reservoir therebetween for receipt of a selected lubricant.

An absorbent pad is positioned radially inward of the fluid impermeable sleeve and an absorbent wick communicates with both the lubricant and the absorbent pad to transmit lubricant from the fluid reservoir to the absorbent pad. Lubricant slowly drips off the pad and drops onto the top of the packing in the stuffing box. A small amount of oil collected on top of the stuffing box packing acts to continually lubricant the polished rod.

In one embodiment of the present invention, the fluid impermeable sleeve is fabricated from metal and incorporates an absorbent pad having a first semi-cylindrical portion and a second semi-cylindrical portion positioned radially inward of the fluid impermeable sleeve. The fluid impermeable sleeve also includes a first upper aperture and a second upper aperture, each first and second upper apertures defining an upper slot extending from an upper surface of the fluid impermeable sleeve axially downward to a corresponding first and second wick engaging surface. A first absorbent wick extends upwardly from the fluid reservoir over the first wick engaging surface of the fluid impermeable sleeve for communication with the first absorbent pad. A second absorbent wick likewise extends upwardly from the fluid reservoir and over the second wick engaging surface of the fluid impermeable sleeve for communication with the second pad.

Lubricant slowly drips from the absorbent pads onto the top of the stuffing box packing where the collected lubricant acts to continuously lubricate the polished rod. Each first and second absorbent wicks therefore communicate with each first and second absorbent pads, respectively, for slowing dripping lubricant on top of the stuffing box packing and thus lubricant the polished rod in a controlled manner. Each first and second semi-cylindrical absorbent pad may be circumferentially engage the polished rod for directly rather than indirectly lubricating the polished rod. A positioning washer engages a shoulder of the gland housing and an upper portion of the fluid impermeable sleeve for radially positioning an upper portion of the fluid impermeable sleeve relative to the gland housing and maintaining alignment of the polished rod within the stuffing box gland.

In another embodiment, an upper wiper housing is secured to the top of the gland housing by a plurality of hex nuts and bolts passing through the top of the gland housing and upper wiper housing. The upper wiper housing includes a central passageway therethrough for receipt of the polished rod. An elastomeric wiper is positioned within the upper wiper housing for wiping a section of the polished rod free of any lubricant as the polished rod moves axially through and above the upper wiper housing. Thus, the lubricant is maintained within the stuffing box gland as the polished rod moves axially through and above the stuffing box gland.

An outlet port is included in the upper wiper housing and a fluid conduit communicates between the outlet port and a recirculating port in the gland housing for returning lubricant from the upper wiper housing to the fluid reservoir, as the polished rod moves axially downward causing lubricant to build up as it engages the elastomeric wiper thus, filling an upper chamber of the upper wiper housing. The lubricant then travels through the upper chamber of the upper wiper housing through the outlet port, fluid conduit and recirculating port until reaching the fluid reservoir where it is then reabsorbed by each first and second absorbent wick member.

A fill port and plug are positioned in an upper portion of the gland housing for intermittently filing the fluid reservoir with a selected lubricant. A drainage port and plug are also positioned in a lower portion of the gland housing for draining the lubricant from the fluid reservoir when necessary.

In yet another embodiment, an overflow port and connector are positioned in an upper portion of the gland housing opposite the recirculating port for receipt of an adaptor to receive and detect overflow of the lubricant from the fluid reservoir. Once detected, the oilfleld pump assembly may be shut down until the problem is rectified.

It is therefore a primary object of the present invention to provide a stuffing box gland capable of maintaining a lubricant in the stuffing box gland. The lubricant uniformly and consistently coats the polished rod by using an absorbent pad and absorbent wick to slowly drip lubricant for engagement with the polished rod.

It is also an object of this invention to provide an improved stuffing box gland for cooperation with the packing within a stuffing box to seal between the stuffing box housing and a moveable polished rod of an oilfield pumping assembly while also reliably lubricating the polished rod.

It is yet another object of the present invention to provide a stuffing box gland having a fluid impermeable sleeve positioned within the gland housing for surrounding the polished rod and defining a fluid reservoir between an exterior surface of the fluid impermeable sleeve and an interior surface of the gland housing for receipt of a lubricant.

An important feature of the present invention is to provide a stuffing box gland that utilizes a minimum number of component parts and is simple to fabricate and employ.

It is another important feature of the present invention to provide a stuffing box gland with an absorbent member positioned radially inward of a fluid impermeable sleeve and in surrounding relationship to the polished rod. The absorbent member is attached to an absorbent wick that passes through the fluid impermeable sleeve into a fluid reservoir for communication with a lubricant that is transmitted from the fluid reservoir to the absorbent pad. The lubricant drips off the absorbent pad onto the top of the stuffing box packing, where it acts to uniformly and consistently lubricate and cool the polished rod. The absorbent member thus serves as a low cost lubricant dispenser.

It is yet another important feature of the present invention to provide an elastomeric seal for sealing between the lower end of the fluid impermeable sleeve and an annular seat in the stuffing box gland.

Another important feature of the present invention to provide a positioning washer in engagement with an upper end of the fluid impermeable sleeve and extending radially outward therefrom for engagement with a shoulder in the gland housing for radially positioning an upper portion of the fluid impermeable sleeve relative to the gland housing.

It is yet another important feature of the present invention to provide an overflow port in the stuffing box gland for attachment of an adaptor to receive and detect overflow lubricant from the fluid reservoir.

Another important feature of the present invention is to provide a stuffing box gland with an anti-pollution stuffing box adaptor for automatically shutting off the oilfleld pumping assembly when packing within the stuffing box begins to leak in the fluid reservoir and the stuffing box gland begins to overflow.

It is yet another important feature of the present invention to provide a stuffing box gland with a unitary fluid impermeable sleeve that is easily replaced and creates a fluid reservoir between an exterior surface of the fluid impermeable sleeve and an interior surface of the stuffing box gland.

It is yet another important feature of the present invention to incorporate one or more absorbent pads and corresponding wicks radially inward of a fluid impermeable sleeve that are easily replaceable, inexpensive to manufacture and provide for the uniform supply of lubricant to a polished rod in an oilfield pumping assembly.

It is yet another important feature of the present invention to provide a stuffing box gland having an upper wiper housing positioned axially above a fluid reservoir and including a central passageway therethrough for receipt of a polished rod in an oilfield pumping assembly.

It is yet another important feature of the present invention to include an elastomeric wiper positioned within an upper wiper housing of the stuffing box gland for wiping the polished rod to retain lubricant within an interior of the upper wiper housing.

It is yet another important feature of the present invention to provide a recirculating conduit communicating between an outlet port in the upper wiper housing and a recirculation port in the stuffing box gland for recirculating a lubricant from the upper wiper housing to the fluid reservoir in the stuffing box gland.

These and further objects, features and advantages of the present invention become apparent from the following detailed description, wherein reference is made to the figures in the accompanying drawings.

DETAILED DESCRIPTION OF PREFERRED EMBODIMENTS

Figure 1:
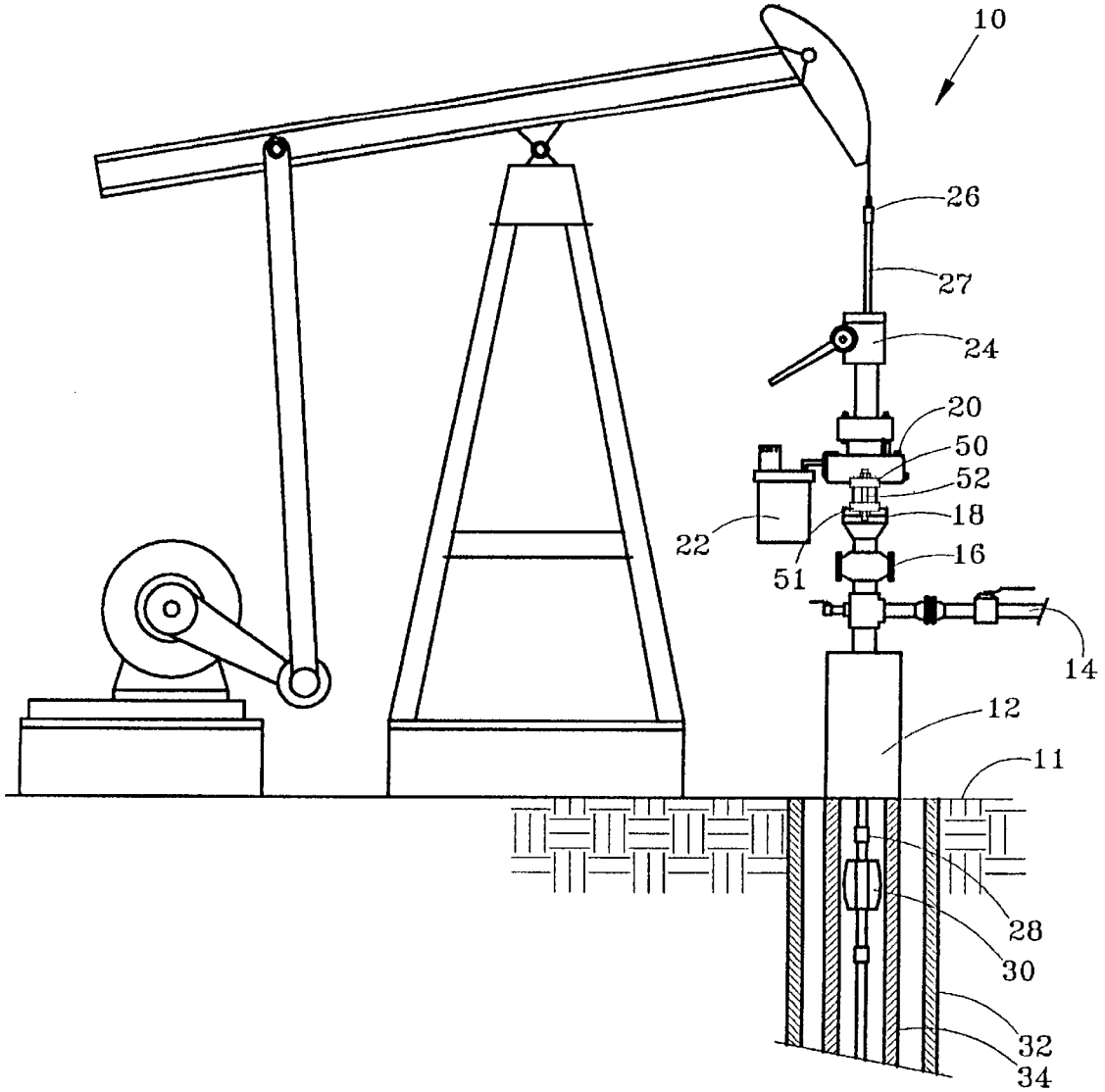
FIG. 1 is a vertical elevation of an oilfield pumping assembly and its various component parts.

Referring generally to FIG. 1, an oilfield pump assembly 10 is shown. Above a ground or surface level 11, the pump assembly generally includes a tubing head 12, a pressure regulator or control valve 14, a blowout preventer 16, a stuffing box 18, a stuffing box gland 20 attached to an anti-pollution adapter 22, a rod rotator 24 and a polished rod clamp 26. In a preferred embodiment of the present invention, a plurality of bolts 52 are adjustably secured between a flange 50 on a lower end of the stuffing box gland 20 and a flange 51 on an upper end of the stuffing box 18 for varying a compressive force exerted by the lower end of the stuffing box gland 20 on packing (not shown in FIG. 1) within the stuffing box 18. Below the ground or surface level 11, the oilfield pump assembly 10 includes a coupler sucker rod 28 interconnecting rods of a reciprocating or rotating rod string. A centralizer 30 is positioned on the rod to centralize the rod string within a tubular 34 positioned inside a well casing 32.

The present invention incorporates a novel stuffing box gland 20 that replaces the conventional upper lubricating gland. The stuffing box gland 20 is connected above the stuffing box 18, eliminating redundant parts and prolonging lubrication and cooling of the polished rod 27 as it passes mechanical power to the rod string.

Figure 2:
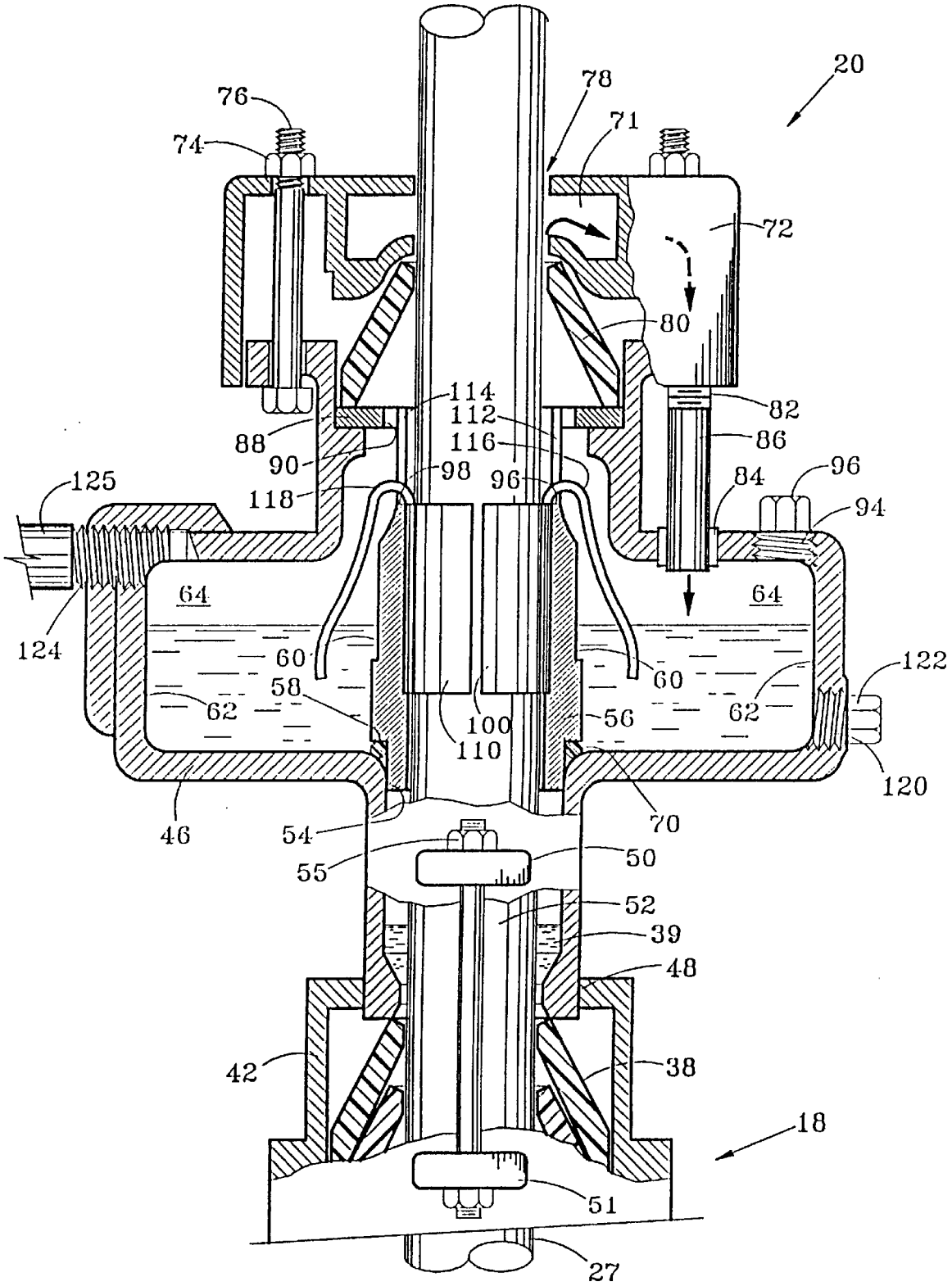
FIG. 2 is a vertical cross-sectional view of the present invention illustrating the stuffing box housing and stuffing box gland.

Referring now to FIG. 2, the stuffing box gland 20 is generally shown in cooperation with a packing 38 housed within the stuffing box 18 to seal between a stuffing box housing 42 and the polished rod 27. In a preferred embodiment, the stuffing box gland 20 includes a gland housing 46 having a central passageway therethrough for receipt of the polished rod 27 and a first flange 50 extending radially outward from a lower end 48 of the gland housing 46. A second flange (not shown) also extends radially outward and circumferentially opposite the first flange 50 on a lower end 48 of the gland housing 46. A plurality of attachment members or bolts 52 are utilized, each bolt sized to pass through a respective flange 51 extending radially outward from the stuffing box housing 42 to secure the flange 50 to a respective flange 51 by a hex nut 55. Selective adjustment of the bolts 52 may thus vary the compressive force exerted on the packing 38 by the lower end 48 of the gland housing 46. The lower end 48 of the gland housing 46 thus forcibly engages the top of the packing 38 to form an annular chamber 39 above the packing 38 and within the gland housing 46. The chamber 39 thus acts as a reservoir for holding a small quantity, e.g., ¼ inch to 1 inch, of lubricant above the packing 38 and in engagement with the polished rod. Additional gland housing flanges and corresponding stuffing box housing flanges may be incorporated as desired to exert a necessary compressive force on the packing in the stuffing box and seal between the lower end of the gland housing and the stuffing box, with the stuffing box packing acting as the elastomeric seal between the gland housing and the stuffing box housing.

An annular seat 54 is fixedly positioned within the gland housing 46 and circumferentially about the central passageway. A fluid impermeable sleeve 56 is positioned within the gland housing 46 and surrounds the polished rod 27 passing therethrough. An elastomeric seal, such as O-ring 70, may be utilized for sealing between a lower end 58 of the fluid impermeable sleeve 56 and the annular seat 54 to retain the lubricant in a fluid reservoir 64 defined by an exterior surface 60 of the fluid impermeable sleeve 56 and an interior surface 62 of the gland housing 46. In another embodiment, the fluid impermeable sleeve 56 forms a metal to metal seal between the lower end 58 of the fluid impermeable sleeve 56 and the annular seat 54, thereby defining a fluid reservoir 64 between the exterior surface 60 of the fluid impermeable sleeve 56 and an interior surface 62 of the gland housing 46.

A positioning washer 88 engages an upper shoulder 90 of the gland housing 46 and an upper portion of the fluid impermeable sleeve 56 for radially positioning an upper portion of the fluid impermeable sleeve 56 relative to the gland housing 46 and maintaining alignment of the polished rod 27 within the stuffing box gland 20.

In a preferred embodiment, the fluid impermeable sleeve 56 is fabricated from metal. An absorbent member such as a pad is provided having a first semi-cylindrical portion 100 and a second semi-cylindrical portion 110 positioned radially inward of the fluid impermeable sleeve 56. Alternatively, a single unitary absorbent member may be positioned in the annulus between the fluid impermeable sleeve 56 and the polished rod. The fluid impermeable sleeve 56 also includes first and second upper apertures, each first and second upper aperture defining a first 112 and second 114 upper slot extending from an upper surface of the fluid impermeable sleeve 56 axially downward to a corresponding first 98 and second 96 wick engaging surface.

A first absorbent wick 116 extends upwardly from the fluid reservoir 64 and over the first wick engaging surface 98 of the fluid impermeable sleeve 56 for communication with the first semi-cylindrical absorbent pad 100. A second absorbent wick 118 likewise extends upwardly from the fluid reservoir 64 and over the second wick engaging surface 96 of the fluid impermeable sleeve 56 for communication with the second semi-cylindrical pad 110. The lubricant on the pads thus slowly drips onto the top of the stuffing box packing, thereby serving to lubricate the polished rod. Each first 116 and second 118 absorbent wick therefore communicates between each first 100 and second 110 semi-cylindrical absorbent pad, respectively, and the fluid reservoir 39 for transferring lubricant to the polished rod 27 in a controlled manner. In addition to acting to slowly drip lubricant on top of the stuffing box gland, each first 100 and second 110 absorbent pad may also engage the polished rod 27 for directly lubricating all or a portion of the polished rod 27.

It should be understood that the pads 100 and 110 need not generally conform to the outer surface of the rod and need not be generally sandwiched between the rod and the sleeve 56, as shown in FIG. 2. Instead, a substantial annular gap may exist between the inside diameter of the sleeve 56 and the outside diameter of the rod, and the pads 100 and 110 may be angled radially inward from the top of the sleeve downward to loosely engage the rod at a point below the top of the sleeve. The pads need not touch the rod for the lubrication system to effectively function. If the lower ends of the pads 100 and 110 do not contact the rod, the pads may still indirectly lubricate the rod, rather than directly lubricating the rod by slowly dripping oil into the reservoir 39, as explained above. The same stuffing box gland with one size sleeve 56 may thus be used for lubricating rods of various diameters which are much less than that shown in FIG. 2. A typical stuffing box may thus be used with polished rods ranging from 1 inch to 1¾ inch in diameter without modifying the stuffing box. Even when the stuffing box gland is used on the largest diameter rod capable of passing through the sleeve 56, the gap between the sleeve and the rod is radially thicker than the radial thickness of this annular gap. This is desirable to facilitate replacement of the wick and the pad, particularly if the rod is slightly eccentric with respect to the central axis of the stuffing box gland and thus the sleeve 56.

In another embodiment, each first 116 and second 118 absorbent wick extends through corresponding first and second openings (not shown) in the fluid impermeable sleeve 56. Each first and second opening restricts the lubricant in the fluid reservoir 64 from communicating with the polished rod 27 except through each first 116 and second 118 absorbent wick, regardless of whether the lubricant rises above the level of each first and second opening in the fluid impermeable sleeve 56. The compact wick material in each opening prevents excessive lubricant flow onto the rod, even if the lubricant level is above the position of the hole.

In a preferred embodiment, an upper wiper housing 72 is secured to the top of the gland housing 46 by a plurality of hex nuts 74 and bolts 76 passing through the top of the gland housing 46 and upper wiper housing 72. The upper wiper housing 72 includes a central passageway 78 therethrough for receipt of the polished rod 27. An elastomeric wiper 80 is positioned within the upper wiper housing 72 for wiping a section of the polished rod 27 free of any lubricant as the polished rod 27 moves axially through and above the upper wiper housing 72. Thus, the lubricant is maintained within the stuffing box gland 20 as the polished rod 27 moves axially through and above the stuffing box gland 20. Alternatively, the upper wiper housing 72 may be eliminated and a separate or integral cap (not shown) having an elastomeric seal for restricting the lubricant to the stuffing box gland may be included.

An outlet port 82 is included in the upper wiper housing 72 and a fluid conduit 86 communicates between the outlet port 82 and a recirculating port 84 in the gland housing 46 for returning lubricant from the upper wiper housing 72 to the fluid reservoir 64, as the polished rod 27 moves axially downward causing lubricant to build up as it engages the elastomeric wiper 80 thus, filling an upper chamber 71 of the upper wiper housing 72. The wiper 80 thus keeps excess lubricant off the polished rod and returns the excess lubricant to the gland housing. The wiper 80 also keeps dirt off the polished rods during the downstroke of the rod. As the amount of the lubricant in the upper chamber 71 increases, it follows a path indicated by the arrows in FIG. 2 through the outlet port 82, fluid conduit 86 and recirculating port 84 until reaching the fluid reservoir 64 where it is then reabsorbed by each first 116 and second 118 absorbent wick member.

A fill port 94 and plug 96 are positioned in an upper portion of the gland housing 46 for intermittently filling the fluid reservoir 64 with a selected lubricant. A drainage port 120 and plug 122 are positioned in a lower portion of the gland housing 46 for draining the lubricant from the fluid reservoir 64 when necessary.

In a preferred embodiment, an overflow port 124 and connector 125 are positioned in an upper portion of the gland housing 46 opposite the recirculating port 84 for receipt of an adaptor 22 to receive and detect overflow of the lubricant from the fluid reservoir 64. Thus, an anti-pollution stuffing box adapter may be connected to the stuffing box gland 20 to automatically shut down the oilfield pump assembly 10 when the packing 38 begins to leak excessively.

Various modifications will be suggested from the above description. For example, the sleeve 56 may be integrally formed with the gland housing 46, so that no seal is necessary between the lower end of the sleeve and the gland housing. Also, one or more wicks and associated pads may be used, or different numbers of wicks and pads. The size of the wicks and the pads may be increased or decreased. A reasonably large surface area of the pads has certain advantages in reducing the likelihood of the pad being pulled upward during the upstroke of the rod, so that the pad is then above the top of the sleeve 56. This is undesirable, since the pad may then fall off the sleeve 56 and into the oil or other lubricant contained within the housing 46. While no particular holder for securing the wick and the pad in place is required, any number of suitable clips or other holders may be used for this purpose. While the preferred sleeve 56 is fabricated from metal, the sleeve could be formed from other materials, such as plastic.

An absorbent member such as a pad may thus be positioned within the annulus between the sleeve 56 and the polished rod to serve as a low cost lubricant dispenser which slowly drips lubricant on the top of the packing in the stuffing box, thereby controllably lubricating the polished rod. A conventionally sized lubricant reservoir within the gland housing 46 may thus reliably lubricate the rod for an extended period of time. The rate at which the wick in combination with the pad lubricate the rod can be increased or decreased by altering the absorbency of these materials, as well as the size of these materials.

Those skilled in the art will appreciate that other types of lubricant dispensing mechanisms may be used, although the combination of a wick and absorbent pad is a low cost and effective mechanism for accomplishing this objective. Higher cost mechanisms may include, for example, a flexible tube passing through the sleeve 56 with a valve positioned along this tube. The valve may be of the type commonly used in medical applications to slowly drip fluid to a patient connected to an intravenous tube. Various conventional mechanisms may then be used for altering the time between the drips. The dripping action of the lubricating system in accord with the present invention desirably is, however, much slower than that commonly used in the medical application described above. Other suitable but higher cost lubricant dispensing mechanisms may include a system wherein a selected amount of lubricant, e.g., one drop, is dispensed as a function of time the rod is moving relative to the stuffing box gland or as a function of the actual movement of the rod through the stuffing box. For example, a lubricant dispensing mechanism may be activated when the rod either rotates or reciprocates a selected amount of time within the stuffing box gland, e.g., a drop of lubricant may be dispensed during every 15 minutes of operation. In another technique, a sensor (not shown) is provided within the stuffing box gland for sensing the reciprocating or rotating motion of the polished rod within the stuffing box gland, and a drop of lubricant is dispensed after a certain number of polished rod strokes or rotations.

The stuffing box gland described above is well suited for use on an oilfield pumping assembly which utilizes a reciprocating rod string and thus a reciprocating polished rod which passes power to a downhole pump. The stuffing box gland may also be used, however, on an oilfield pumping assembly which powers a PC or progressive cavity pump with a rotating rod string so that the rotating polished rod passing through the stuffing box is also lubricated.

Although the invention has thus been described in detail for these embodiments, it should be understood that this explanation is for illustration, and that the invention is not limited to these embodiments. Alternate components and installation techniques will be apparent to those skilled in the art in view of this disclosure. Additional modifications are thus contemplated and may be made without departing from the spirit of the invention, which is defined by the claims.

What is claimed is:

1. A stuffing box gland for cooperation with packing within a stuffing box to seal between a stuffing box housing and a polished rod of an oilfield pumping assembly, the polished rod being movable relative to the stuffing box housing, the stuffing box gland comprising:

a gland housing having a central passageway therethrough for receipt of the polished rod, a lower end of the gland housing adapted for transmitting a compressive force to the packing within the stuffing box, and a flange extending radially outward from the gland housing;

a plurality of attachment members for interconnecting the flange and the stuffing box housing, such that selective adjustment of the attachment members varies the compressive force of the lower end of the gland housing exerted on the packing;

a fluid impermeable sleeve positioned within the gland housing for surrounding the polished rod, the sleeve having a lower end for engagement with the gland housing, an exterior surface of the sleeve and an interior surface of the gland housing defining a fluid reservoir therebetween for receiving a lubricant; and a lubricant dispenser positioned radially inward of the sleeve.

2. The stuffing box gland as defined in claim 1, further comprising:

an annular seat fixedly positioned within the gland housing and circumferentially about the central passageway for sealed engagement with the lower end of the fluid impermeable sleeve.

3. The stuffing box gland as defined in claim 2, further comprising:

an elastomeric seal for sealing between the lower end of the fluid impermeable sleeve and the annular seat to retain lubricant in the fluid reservoir.

4. The stuffing box gland as defined in claim 1, further comprising:

an upper wiper housing positioned axially above and secured to the gland housing, the upper wiper housing having a central passageway therethrough for receiving the polished rod; and an elastomeric wiper positioned within the upper wiper housing for wiping the polished rod to retain lubricant within the interior of the upper wiper housing.

5. The stuffing box gland as defined in claim 4, further comprising:

an outlet port in the upper wiper housing:

a recirculating port in the gland housing; and a fluid conduit for communication between the outlet port and the recirculating port to return lubricant to the fluid reservoir from the upper wiper housing.

6. The stuffing box gland as defined in claim 1, further comprising:

a positioning washer in engagement with an upper end of the fluid impermeable sleeve and extending radially outward therefrom for engagement with the gland housing for radially positioning an upper portion of the fluid impermeable sleeve relative to the gland housing.

7. The stuffing box gland as defined in claim 1, further comprising:

a fill port in an upper portion of the gland housing for intermittently filling the fluid reservoir with a selected lubricant.

8. The stuffing box gland as defined in claim 1, wherein the lubricant dispenser comprises:

an absorbent wick for communication with both the lubricant and the lubricant dispenser to transmit lubricant from the fluid reservoir to the lubricant dispenser, thereby lubricating the polished rod; and an absorbent pad, the absorbent wick extending upwardly from the fluid reservoir and above a wick engaging surface of the fluid impermeable sleeve for communication with the absorbent pad.

9. The stuffing box gland as defined in claim 8, wherein:

the absorbent pad is positioned in an annulus between the fluid impermeable sleeve and the polished rod.

10. The stuffing box gland as defined in claim 9, wherein the fluid impermeable sleeve includes an upper aperture, and the wick extends upward from the fluid reservoir and through the upper aperture for engagement with the absorbent pad.

11. The stuffing box gland as defined in claim 10, wherein:

the upper aperture defines an upper slot extending from an upper surface of the fluid impermeable sleeve axially downward to a wick engaging surface of the fluid impermeable sleeve; and the wick extends upward from the fluid reservoir and above the wick engaging surface of the fluid impermeable sleeve for engagement with the absorbent pad.

12. The stuffing box gland as defined in claim 7, further comprising:

a drainage port in the gland housing spaced axially below the fill port for draining the lubricant from the fluid reservoir.

13. The stuffing box gland as defined in claim 2, further comprising:

an overflow port in the gland housing spaced axially intermediate the annular seat and an upper end of the gland housing; and an adapter to receive and detect overflow of the lubricant from the fluid reservoir.

14. A stuffing box gland for cooperation with packing within a stuffing box to seal between a stuffing box and a reciprocating polished rod of an oilfield pumping assembly, the polished rod being axially movable relative to the stuffing box housing, the stuffing box gland comprising:

a gland housing having a central passageway therethrough for receipt of the polished rod, and a flange extending radially outward from a lower end of the gland housing for connection with the stuffing box housing, such that the lower end of the gland housing transmits a compressive force on the packing within the stuffing box;

an upper wiper housing positioned axially above and secured to the gland housing, the upper wiper housing having a central passageway therethrough for receiving the polished rod;

an elastomeric wiper positioned within the upper wiper housing for wiping the polished rod to retain lubricant within the interior of the upper wiper housing;

a fluid impermeable sleeve positioned within the gland housing for surrounding the polished rod, the sleeve having a lower end for engagement with the gland housing, and exterior surface of the sleeve and an interior surface of the gland housing defining a fluid reservoir therebetween for receiving a lubricant;

an absorbent member positioned radially inward of the sleeve; and an absorbent wick extending upwardly from the fluid reservoir and in communication with a wick engaging surface of the fluid impermeable sleeve for transmitting lubricant from the fluid reservoir to the absorbent member, thereby lubricating the polished rod.

15. The stuffing box gland as defined in claim 14, further comprising:

an outlet port positioned above the elastomeric wiper in the upper wiper housing;

a recirculating port in the gland housing; and a fluid conduit for communication between the outlet port and the recirculating port to return lubricant to the fluid reservoir from the upper housing above the elastomeric wiper.

16. The stuffing box gland as defined in claim 14, further comprising:

a plurality of attachment members for interconnecting the flange and the stuffing box housing, such that selective adjustment of the attachment members varies the compressive force of the lower end of the gland housing exerted on the packing.

17. The stuffing box gland as defined in claim 14, wherein the absorbent member including an absorbent pad which engages at least a portion of the polished rod for lubricating the polished rod.

18. The stuffing box gland as defined in claim 14, further comprising:

an annular seat fixedly positioned within the gland housing and circumferentially about the central passageway for sealed engagement with the lower end of the fluid impermeable sleeve.

19. The stuffing box gland as defined in claim 14, further comprising:

an upper aperture positioned in the fluid impermeable sleeve; and the absorbent wick extending upward from the fluid reservoir and through a respective upper aperture in the fluid impermeable sleeve for engagement with the absorbent member.

20. The stuffing box gland as defined in claim 14, further comprising:

an overflow port in the gland housing spaced axially intermediate the annular seat and an upper end of the gland housing; and an adaptor to receive and detect overflow of the lubricant from the fluid reservoir.

* * * * *